US008133333B2

(12) United States Patent
Branagan et al.

(10) Patent No.: US 8,133,333 B2
(45) Date of Patent: Mar. 13, 2012

(54) PROCESSING METHOD FOR THE PRODUCTION OF NANOSCALE/NEAR NANOSCALE STEEL SHEET

(75) Inventors: Daniel James Branagan, Idaho Falls, ID (US); Joseph Buffa, Maitland, FL (US); Michael Breitsameter, Providence, RI (US); David Paratore, Warren, RI (US)

(73) Assignee: The NanoSteel Company, Inc., Providence, RI (US)

( * ) Notice: Subject to any disclaimer, the term of this patent is extended or adjusted under 35 U.S.C. 154(b) by 343 days.

(21) Appl. No.: 11/874,361

(22) Filed: Oct. 18, 2007

(65) Prior Publication Data

US 2008/0213517 A1 Sep. 4, 2008

Related U.S. Application Data

(60) Provisional application No. 60/829,988, filed on Oct. 18, 2006.

(51) Int. Cl.
*C21D 9/46* (2006.01)

(52) U.S. Cl. ..... 148/561; 148/579; 148/541; 148/661

(58) Field of Classification Search ..... 148/561, 148/403, 579, 541, 661; 164/481
See application file for complete search history.

(56) References Cited

U.S. PATENT DOCUMENTS 4,297,135 A * 10/1981 Giessen et al. ..... 148/321
4,552,201 A * 11/1985 Wood ..... 164/481
4,576,653 A * 3/1986 Ray ..... 419/61
5,056,585 A * 10/1991 Croat ..... 164/463
5,379,828 A 1/1995 Blazek et al.
6,168,673 B1 * 1/2001 Kanekiyo et al. ..... 148/122
2004/0060620 A1 4/2004 Ma et al.
2005/0252586 A1 11/2005 Branagan
2005/0263216 A1 12/2005 Chin et al.
2006/0180252 A1 8/2006 Branagan

FOREIGN PATENT DOCUMENTS

WO 2006086350 8/2006

OTHER PUBLICATIONS

Machine-English translation of Japanese patent 2001-150107, Tsunoda Hiroaki et al., Jun. 5, 2001.*

International Search Report dated Mar. 27, 2008 issued in related International Patent Application No. PCT/US07/81810 (2 pages).

Physics Web, "Microscope focuses on sub-Angstrom Scales," dated Sep. 16, 2004; available at htpp://physicsweb.org/articles/news/8/9/11; retrieved on Oct. 18, 2006 (3 pages).

Hazelett, "Casting Machines," available at www.hazelett.com/casting_machines/index.php; retrieved on Oct. 13, 2006 (2 pages).

(Continued)

*Primary Examiner* — Deborah Yee
(74) *Attorney, Agent, or Firm* — Grossman, Tucker, Perreault & Pfleger, PLLC

(57) ABSTRACT

The present disclosure relates to an iron alloy sheet comprising α-Fe, and/or γ-Fe phases wherein the alloy has a melting point in the range of 800 to 1500° C., a critical cooling rate of less than $10^5$ K/s and structural units in the range of about 150 nm to 1000 nm.

8 Claims, 6 Drawing Sheets

OTHER PUBLICATIONS

Hazelett, "Inert Gas," available at http://www.hazelett.com/technology/strip_casting_technology/mold_interface/inert_gas/inert_gas.php; retrieved on Oct. 13, 2006 (1 page).
Hazelett, "Matrix Coating" available at http://www.hazelett.com/technology/strip_casting_technology/mold_interface/matrix_coating/matrix_coating.php; retrieved on Oct. 13, 2006 (1 page).
Hazelett, "Mold Tapering" available at http://www.hazelett.com/technology/strip_casting_technology/mold_tapering/mold_tapering.php; retrieved on Oct. 13, 2006 (1 page).
Hazelett, "ESP Coating" available at http://www.hazelett.com/technology/strip_casting_technology/mold_interface/esp_coating/esp_coating.php; retrieved on Oct. 13, 2006 (1 page).
Hazelett, "Mold Interface" available at http://www.hazelett.com/technology/strip_casting_technology/mold_interface/mold_interface.php; retrieved on Oct. 13, 2006 (1 page).
Hazelett, "Magnetic Back Up Rolls" available at http://www.hazelett.com/technology/strip_casting_technology/belt_stabilization/magnetic_back_up_rolls/magnetic_back_up_rolls.php; retrieved on Oct. 13, 2006 (1 page).
Hazelett, "Induction Belt Preheating" available at Hazelett, Introduction Belt Preheating; retrieved on Oct. 13, 2006 (1 page).
Hazelett, "Belt Stabilization" available at http://www.hazelett.com/technology/strip_casting_technology/belt_stabilization/belt_stabilization.php; retrieved on Oct. 13, 2006 (1 page).
Hazelett, "Strip Casting Technology" available at http://www.hazelett.com/technology/strip_casting_technology/strip_casting_technology.php; retrieved on Oct. 13, 2006 (1 page).
Hazelett, "Metal Feeding" available at http://www.hazelett.com/technology/strip_casting_technology/metal_feeding/metal_feeding.php; retrieved on Oct. 13, 2006 (1 page).
Hazelett, "Open Pool Feeding" available at http://www.hazelett.com/technology/strip_casting_technology/metal_feeding/open_pool_feeding/open_pool_feeding.php; retrieved on Oct. 13, 2006 (1 page).
Hazelett, "Closed Pool Feeding" available at http://www.hazelett.com/technology/strip_casting_technology/metal_feeding/closed_pool_feeding/closed_pool_feeding.php; retrieved on Oct. 13, 2006 (1 page).
Berkeley Lab Research News, "Imaging Lithium Atoms," available at http://www.lbl.gov/Science-Articles/ Archive/MSD-1-Ang-microscope.html; retrieved on Oct. 18, 2006 (5 pages).
Berkeley Lab Research News, "One Angstrom Microscope Achieves Sub One-Angstrom Resolution," available at http://www.lbl.gov/Science-Articles/Archive/less-one-angstrom.html; retrieved on Oct. 18, 2006 (4 pages).
Oak Ridge National Laboratory, "ORNL Microscope pushes back barrier of 'how small'," dated Sep. 17, 2004; available at http://www.ornl.gov/info/press_releases/get_press_release.cfm?ReleaseNumber=mr20040917-00; retrieved on Oct. 18, 2006 (2 pages).
Wikipedia, "Scanning Electron Microscope," available at http://en.wikipedia.org/wiki/Scanning_electron_microscope; retrieved on Oct. 17, 2006 (5 pages).
Wikipedia, "Confocal Laser Scanning Microscopy" available at http://en.wikipedia.org/wiki/Confocal_laser_scanning_microscope; retrieved on Oct. 17, 2006 (4 pages).
Wikipedia, "Electron Backscatter Diffraction" available at http://en.wikipedia.org/wiki/EBSD; retrieved on Oct. 17, 2006 (2 pages).
Wikipedia, "High Resolution Transmission Electron Microscopy" available at http://en.wikipedia.org/wiki/HRTEM; retrieved on Oct. 17, 2006 (6 pages).
Wikipedia, "Electron Diffraction" available at http://en.wikipedia.org/wiki/Electron_diffraction; retrieved on Oct. 17, 2006 (6 pages).
Wikipedia, "Transmission Electron Microscopy" available at http://en.wikipedia.org/wiki/Transmission_electron_microscope; retrieved on Oct. 17, 2006 (5 pages).
Center for Nanoscale Science and Technology, "Kerr Microscopy, 'Confocal' Scanning Kerr Microscope," available at http://cnst.nist.gov/Facilities/kerr.html; retrieved on Oct. 17, 2006 (2 pages).
UK Surface Analysis Forum, "MOKE—Magneto-Optic Kerr Effect; SMOKE—Surface Magneto-Optic Kerr Effect," available at http://www.uksaf.org/tech/moke.html; retrieved on Oct. 17, 2006 (1 page).
Sanders, "Technology Innovation in Aluminum Products," JOM 53 (2) (2001), pp. 21-25; retrieved on Oct. 13, 2006 from http://www.tms.org/pubs/journals/JOM/0102/Sanders-0102.html (12 pages).
Yue, et al., "Fictive Temperature, Cooling Rate, and Viscosity of Glasses," Journal of Chemical Physics, vol. 120, No. 17, May 1, 2004 (7 pages).
Zhao, et al., "Structural Modification of Silica Glass by Laser Scanning,"Journal of Applied Physics; Journal vol. 95; Journal Issue 10, published May 15, 2004 (abstract enclosed, 2 pages).
The Nanosteel Company,"Products, SHS 7214 MIG Weld Wire," available at www.nanosteelco.com/products/7214_weld.shtml; retrieved on Sep. 25, 2006 (3 pages).
Koseki, et al., "Undercooling and Rapid Solidification of FE-CR-NI Ternary Alloys," Apr. 2004 (abstract enclosed 3 pages).
NASA, "It Floats, New MSFC Tool Levitates Molten Materials," available at http://spacescience.spaceref.com/newhome/headlines/msad09mar98_1.htm; retrieved on Sep. 8, 2006 (4 pages).
NASA, "Liquid Below Freezing" available at http://science.nasa.gov/newhome/headlines/msad09mar98_2.htm; retrieved on Sep. 8, 2006 (1page).
NASA, "Undercooling of a Liquid" available at http://science.nasa.gov/ssl/msad/dtf/under1.htm; retrieved on Sep. 8, 2006 (1page).
PHYSICSHOME.COM, "Did You Know?: UnderCooling," Posted on Apr. 18, 2004; available at http://physicshome.com; retrieved on Sep. 8, 2006 (1 page).
Branagan DJ: "Enabling Factors Toward Production of Nanostructured Steel on an Industrial Scale", Journal of Materials Engineering and Performance, ASM International, vol. 14, No. 1, Feb. 1, 2005, pp. 5-09.
Branagan DJ et al: "Low-temperature superplasticity in a nanocomposite iron alloy derived from a metallic glass; Low-temperature superplasticity in a nanocomposite iron alloy derived from a metallic glass", Nanotechnology, IOP, Bristol, GB, vol. 14, No. 11, Nov. 1, 2003, pp. 1216-1222.
Extended European Search Report and Opinion dated Apr. 21, 2011 issued in related European Patent Application No. 07863428.4.

* cited by examiner

PROCESSING METHOD FOR THE PRODUCTION OF NANOSCALE/NEAR NANOSCALE STEEL SHEET

CROSS REFERENCE TO RELATED APPLICATIONS

This application claims priority to U.S. Provisional Application No. 60/829,988 filed Oct. 18, 2006.

FIELD OF INVENTION

The present invention relates to a method for producing amorphous, nanoscale or near nanoscale steel from glass forming alloys, wherein the alloys may have an angstrom or near nano-scaled microstructure. The alloys may be formed into sheet, plate or strip.

BACKGROUND

Since Sir Henry Bessemer first patented the twin roll method for the production of steel sheet directly from a liquid melt over 150 years ago, a number of alternate methods of steel production have been developed. Until the 1950's, ingot slab production was the standard practice where steel was poured into stationary molds or casks. Starting in the late 1950's, conventional slab casting through continuous casting was developed as a new route to improve yield, quality, and productivity in the production of steel. It is used to produce semifinished billet, bloom, or slab for subsequent rolling in finishing mills. In 1989, another steel manufacturing process was developed called thin slab casting which was first implemented by Nucor Steel. The process has allowed the production of steel slabs which are typically thinner than those produced by continuous casting. In addition, the process has been cited as one of the two most important developments of the $20^{th}$ Century. In 1998, the twin roll strip casting process (i.e. Castrip®) was developed by Nucor Steel. In the strip casting process, molten steel is poured into a smooth sheet in one step at the desired thickness without the need for subsequent and expensive rolling operations. This is achieved by directing liquid steel through nozzles which are aimed between the gaps of two 500 mm spinning copper alloy casting rolls.

Conventional steel alloys solidify by what may be termed conventional liquid solid transformation routes. By this route, generally a small amount of liquid undercooling may be achieved prior to nucleation, resulting in the formation of coarse structure, due to rapid diffusion at elevated temperatures. Growth of corresponding crystals occurs in a superheated liquid melt, resulting in conventional growth modes such as dendritic or cellular growth. While theoretically, any metallic element or alloy may form a glass, conventional steels may not form glasses under normal solidification conditions as the critical cooling rates for metallic glass formation of conventional steels may be extremely high and generally in the range of $10^6$ to $10^9$ K/s.

In such a manner, conventional steel processes are designed to cover the challenges in solidification of existing steel alloys but are not designed for the particular challenges and technical hurdles found in solidifying glass forming steels. For example the twin roll process may work well for conventional plain carbon steel. This may be because the primary goal is to solidify the material while the material passes through the rolls; maximizing the total amount of heat removal may only be a minor or secondary goal. Since conventional steel alloys may undergo cooling to a few tens of degrees sufficient to solidify the melt, not much heat has to be removed before the solidification occurs.

However, in glass forming systems, in order to avoid crystallization, the undercooling may be from the melting point down to room temperature. It should also be appreciated that a sufficient level of undercooling may be from the melting point down to the glass transition temperature ($T_g$), since below the fictive glass transition temperature diffusion may be so slow that the effective kinetics allows almost a total cooling rate independence. Thus, as discussed above, the total undercooling necessary in conventional steels may generally be ≦50° C. but for glass forming steels, the total undercooling may be much greater and may typically be in the 500° C. to 1000° C., range depending on the alloy chemistry. Such undercooling has limited the maximum thickness of the amorphous structures achievable. Particularly as the amorphous structures solidify they may tend to have low thermal conductivity hindering the removal of thermal energy from the interior of the structure. Thus, solidification behavior in glass forming metallic alloys may be significantly different than what is found in conventional metal solidification.

SUMMARY

In exemplary embodiment, the present disclosure relates to an iron alloy sheet wherein the alloy has a melting point in the range of 800 to 1500° C., a critical cooling rate of less than $10^5$ K/s and structural units in the range of about 150 nm to 1000 nm. The alloy may also include one or more structural units in the range of about 5 to 100 Angstrom or about 10 nm to 150 nm.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
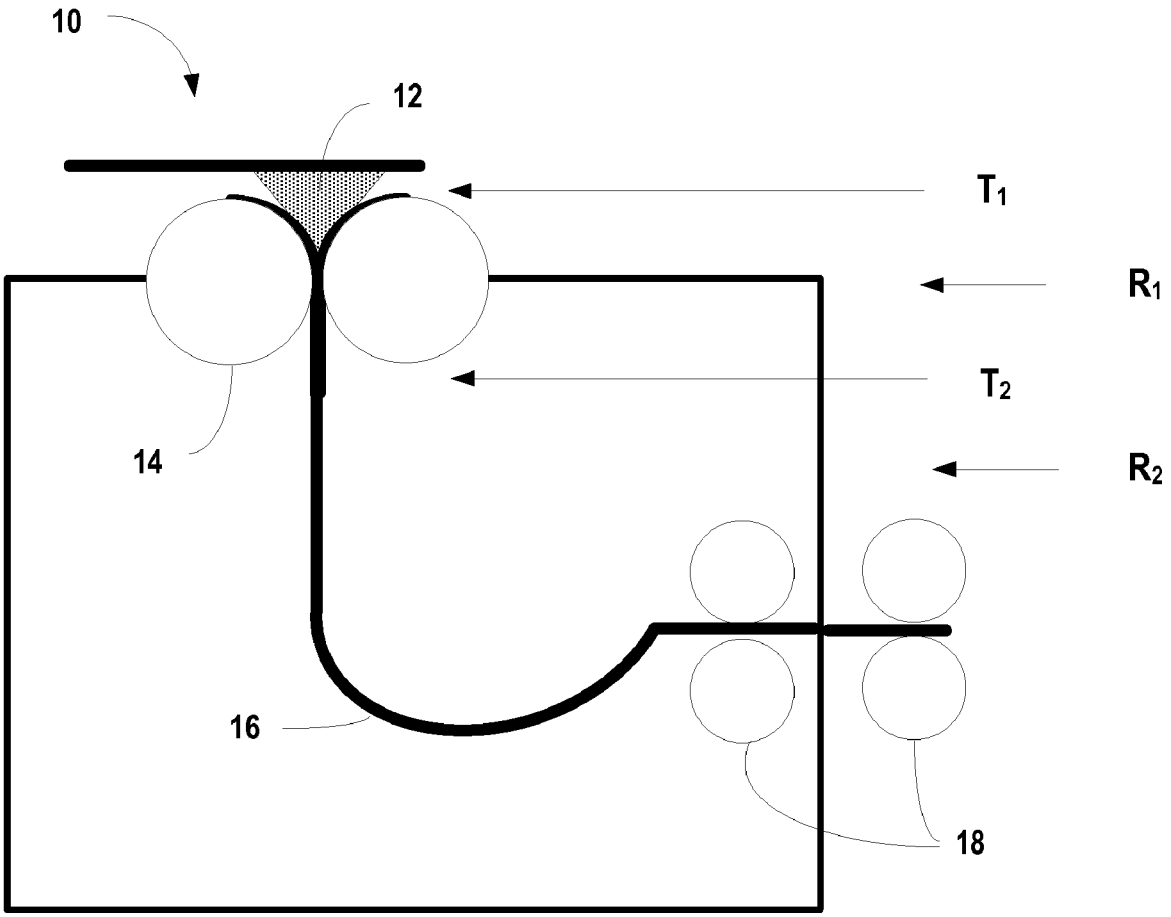
FIG. 1 illustrates a schematic diagram of an exemplary twin roll casting process.

The present invention relates to a method of forming a near nanostructure slab, strip, or sheet steel, out of iron based glass forming alloys. Glass forming steel systems may be classified as metallic/metalloid glasses, wherein relatively little to no crystallization occurs within the metallic matrix. It should be appreciated that in metallic/metalloid glasses associations of structural units in the solid phase of the metallic/metalloid glass may occur, i.e., the glass alloy may include local structural units that may be randomly organized in the solid phase, wherein the structural units may be in the range of 5-100 Angstroms. As the local structural units become more organized, the structure units may increase and may develop phases in the nanoscale, (i.e., 10-150 nm structures), and near-nanoscale regions, (i.e. 150-1000 nm structures).

The alloy chemistries may include multicomponent chemistries, such as chemistries that may be considered steels or steel alloys. A steel alloy may be understood as an alloy wherein the primary constituent (e.g. greater than 50% by weight) may be iron. In addition to iron, an additional 3 to 30 elements may be used as alloy additions. The alloy chemistry may include relatively high concentrations of P-group elements, which are non-metallic and may therefore not be able to form metallic bonds. They may generally include a binary eutectic chemistry consisting of iron plus boron, carbon, silicon, phosphorous and/or gallium. However, a very high percentage of these elements may dissolve in the liquid melt, in the solid glass and to a lesser percentage in the crystalline phases. When dissolved, the P-group atoms may form covalent bonds, tying up free electrons and act to fill up/partially fill up the outer valence band. This may result in a reduction of thermal conductivity, which may be comparable to the range of thermal conductivity associated with ceramic materials, i.e. between 0.1 to 300 W/m-K, including all increments and values therein. Other alloy additions may include transition metals such as chromium, molybdenum, tungsten, tantalum, vanadium, niobium, manganese, nickel, copper, aluminum, and cobalt; and rare earth elements including yttrium, scandium, and the lanthanides.

The melting points of the multi-component alloys may be lower than those of conventional commercial steel alloys and may be in the range of about 800° C. to 1500° C., including all increments and values therein, such as 960° C. to 1375° C., 1100° C., etc. In addition, the alloys may be glass forming, which may have critical cooling rates for metallic glass formation less than $10^5$ K/s, such as between $10^0$ K/s to $10^4$ K/s. The phases formed during solidification may depend on alloy chemistry, processing conditions and thermal history during processing. Exemplary alloys may contain ductile phases like α-Fe and/or γ-Fe along with complex carbide, complex boride, and/or complex borocarbide phases based on various stoichiometries such as $M_2(BC)_1$, $M_3(BC)_2$, $M_{23}(BC)_6$, $M_7(BC)_3$ and/or $M_1(BC)_1$. M may represent any transition metal which may be present within the alloy composition.

Nucleation of glass forming alloys may be inhibited by allowing high undercooling prior to nucleation or the onset of a phase transition. Undercooling may be understood as the lowering of the temperature of a liquid beyond the freezing temperature and still maintaining a liquid form. If the level of undercooling obtained is below the fictive glass temperature, $T_g$, then a metallic glass structure may be achieved. The fictive temperature may be understood as the thermodynamic temperature at which the glass structure may be in equilibrium. Thus, the total undercooling may be in the range of 500° C. to 1000° C. depending on the alloy chemistry, including all ranges and values therein.

Accordingly, nucleation inhibition may occur if the critical cooling rate of metallic glass formation is lower than the average cooling rate of the manufacturing process of the steel alloy. In addition, where nucleation may be at least partially avoided or inhibited, latent heat related to the initiation of nucleation may be reduced or not released. Thus, temperature increases due to nucleation may be minimized, avoiding devitrification and/or avoiding inducing a two-phase liquid/solid region, which may then allow for solidification under conventional nucleation and growth. The metallic glass may exhibit microstructural refinement including an angstrom scaled microstructure. The glass sheet may then be transformed into a nanoscale composite microstructure by a post processing devitrification heat treatment.

The glass forming alloys may be processed using manufacturing approaches such as twin roll casting, strip casting, belt casting, etc., resulting in the development of microstructure scales much finer than conventional steel alloys. Note that the microstructures may include associations of structural units in the solid phase that may be randomly packed together forming an amorphous phase. The level of refinement, or the size, of the structural units may be in the angstrom scale range (i.e. 5 Å to 100 Å) if a metallic glass is formed; if nucleation or crystallization is initiated, the level of refinement may include the nanoscale region (i.e. 10 to 150 nm) and just above the nanoscale range, that is "near nanoscale," (i.e. 150 to 1000 nm). It should therefore be appreciated that the alloy may result in a component that may include structural units in the range of about 5 Å to 100 Å, 10 nm to 150 nm or 150 nm to 1,000 nm, as well as combinations thereof. Accordingly, structural units in the range of about 5 Å to 100 Å, 10 nm to 150 nm or 150 nm to 1,000 nm may all be present in the iron alloy component. Furthermore, structural units in the range of about 5 Å to 100 Å, 10 nm to 150 nm or 150 nm to 1,000 nm, may be present almost exclusively, i.e., at levels greater than 90% by vol.

It should be appreciated that the level of refinement or microstructural scale of the structural units may be determined by various forms of X-ray diffraction with Scherrer analysis to analyze peak broadening, electron microscopy (either scanning electron microscopy or transmission electron microscopy) or Kerr Microscopy utilizing a confocal scanning microscope. For example, scanning electron microscopy (SEM) may be used to produce an electron backscattered diffraction image, by detecting backscattered electrons which may detect the contrast between areas with different chemical compositions. Such an image may be used to determine the crystallographic structure of a specimen. In addition, SEM electron diffraction may be utilized. While the spatial resolution of an SEM may depend on the size of the beam, the resolution may also be dependent on the interaction volume, or the extent of material which may interact with the electron beam. In such a manner, the resolution may be in the range of about 1 to 20 nm.

Transmission electron microscopy (TEM) may also be used to measure the microstructural units using techniques such as selected area diffraction, convergent beam diffraction and observation with or without rocking the beam. As it may be difficult to see the short range order/extended short range order arising from molecular associations due to the extremely fine ordering in metallic glasses, advanced TEM techniques may be used. Dark field transmission electron microscopy may be utilized as well as high resolution transmission electron microscopy or field emission transmission electron microscopy. Furthermore, scanning transmission electron microscope may be used with aberration correction software to produce images on the sub-Angstrom scale.

Magnetic techniques such as direct measurements of domains using a confocal scanning Kerr microscope may be employed to measure domain size as well. Further measurements may also include indirect measurements of nearest neighbor associations leading to magnetic moments, Curie temperature, and saturation magnetization.

In addition, the iron alloy may include 50% or greater by volume (vol.) structural units in the near-nanoscale or in the range of about 150 nm to 1,000 nm, including all values and increments therein. It may also include about 50% or more by vol. of structural units in the range of about 5 Å to 100 Å. Furthermore, the iron alloy may include about 50% or more by vol. of structural units in the range of about 10 nm to 150 nm. Furthermore, the alloy may include structural units in the micron size range, i.e., greater than or equal to about 1 micron.

The properties and/or combination of properties found in the near nanoscale alloy and slab, strip, or sheet produced there from may be outside the existing boundaries of conventional steel sheet and may include extremely high hardness, extremely high tensile strength, superior strength to weight ratios, and enhanced corrosion resistance.

In an exemplary embodiment, glass forming steel alloys may be processed by techniques wherein the alloy may rapidly solidify, which may be understood as cooling the liquid steel in a short period of time so as to retain a microstructural scale which is reduced in size. For example, rapid solidification may be obtained by processing liquid steel on a metal chill surface that may include a high conductivity metal such as a copper, copper alloy, silver, etc. As alluded to above, exemplary rapid solidification techniques include but are not limited to twin roll casting, strip casting, and belt casting, such as horizontal single belt casting. Steel strip, slab, or sheet components may be produced at the minimum number of processing steps and at the lowest practical thicknesses as possible. In an exemplary embodiment, there may be no subsequent rollering stages. Solidified sheet may be understood herein as having, e.g., a thickness from about 0.1 mm to 30 mm in thickness including all increments and values therein, such as 0.5 mm to 15 mm thick, 10 mm thick, etc. Accordingly, by way of example, sheet steel herein may be understood as a sheet of steel having a length and width and the indicated thickness values. Such length and width values may be in the range of 1 to 100 inches wide and 1 to 1000 inches long, including all values and increments therein. In addition, components such as tubes, pipes, or bars may be formed as well.

In an exemplary embodiment, horizontal single belt casting may be utilized wherein a chill surface is provided such that the alloys may remain in contact with the single chilled belt for a desired duration, depending on the length of the belt and roll speed. Accordingly, the bottom fraction of the sheet next to the chill surface may form a glass and the top surface may cool much slower as it cools via radiation and natural convection. Thus, the surface removed from the belt may crystallize at a much lower amount of undercooling, which may result in a release of latent heat. The release of latent heat may then cause a dramatic temperature rise (i.e. recalescence), crystallizing a portion of the underlying liquid melt. It should be appreciated that the increase in temperature may be sufficient to bring the alloys to the liquid region causing localized melting. Accordingly, it may be appreciated that the single chilled belt procedure may only provide relatively reliable glass formation for the bottom fraction and a gradient of differing morphology proceeding to the outer surface.

In another exemplary embodiment, twin roll casting may be utilized wherein the melt may cool rapidly on the rolls. Illustrated in FIG. 1 is a schematic diagram of an exemplary embodiment of a twin roll casting system and method 10. As shown, the liquid steel melt alloy 12 may have a first relatively high temperature prior to contacting the primary cooling rollers 14. When in contact with the rollers, which may be for example copper alloys rollers, the alloy may cool very fast (i.e. conductive) at a first rate $R_1$ and may leave the wheel at a second relatively high temperature $T_2$, which may be somewhat less than the first relatively high temperature $T_1$. After leaving the chill surface, the rate of heat removal may be relatively less than that exhibited at the chill surface (i.e. radiative or naturally convective) and results in a reduced cooling rate $R_2$. The melt may thus be solidified into a strip or sheet 16 and may pass through secondary rollers 18. Thus, the cooling rate in twin roll casting may be characterized as a two stage process.

Figure 2:
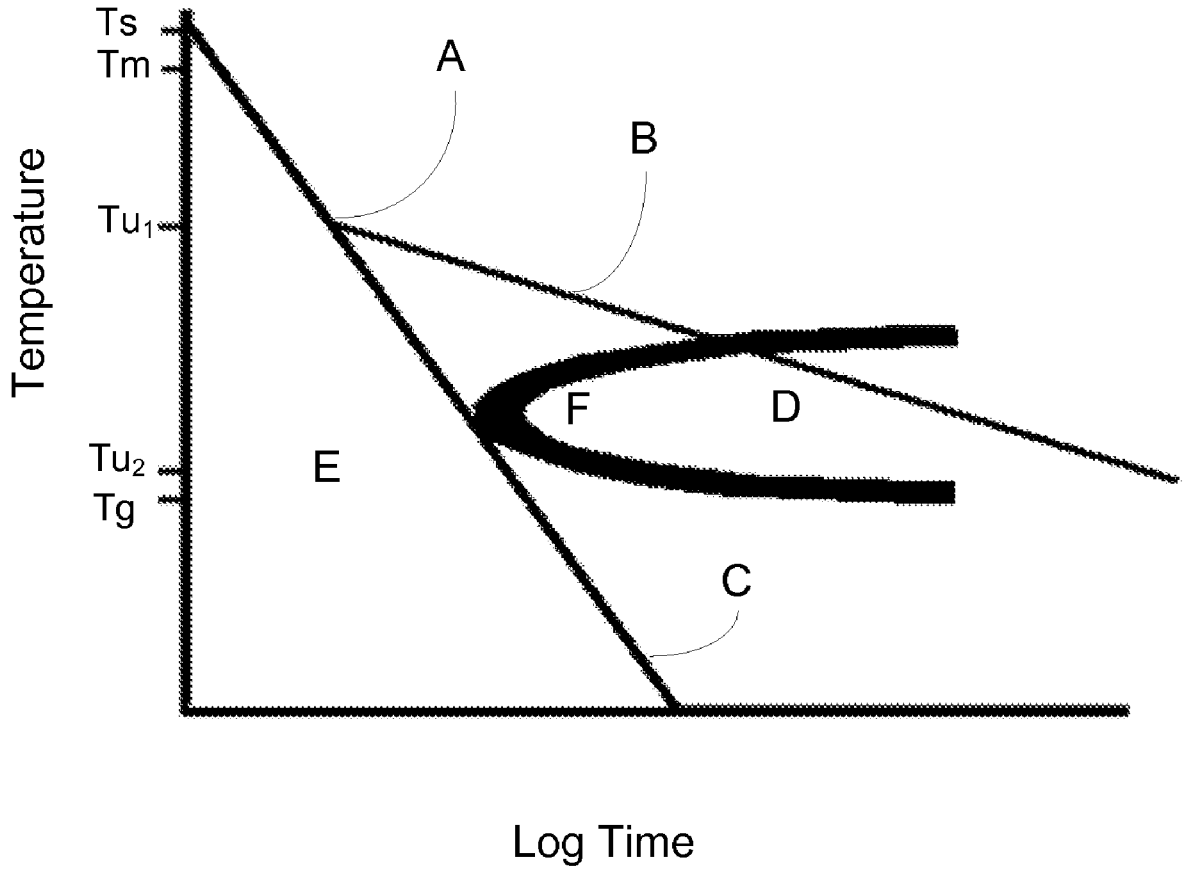
FIG. 2 illustrates a model continuous cooling transformation (CCT) diagram showing the effect of the two stage cooling on metallic glass formation for the twin roll casting process.

The effects of two stage cooling are shown on the model continuous cooling transformation (CCT) diagram for metallic glass forming steel alloys shown in FIG. 2, wherein the C-Curve D represents is the glass to crystalline transformation region and E represents the glassy region. As shown, the initial cooling curve C is rapid and in the range of possible development of glass forming steel chemistries. However, the total amount of heat removal may be insufficient and the liquid melt may come off the wheel in a moderately undercooled condition at A. The much slower cooling rate B of the liquid melt once removed from the wheel may result in the formation of relatively larger crystals (i.e. >10 μm) since the nose of the glass to crystalline transformation (point F) is may almost be entirely avoided. In FIG. 2, it should be appreciated that Ts refers to the superheat temperature, Tm refers to the melting point of the alloy, $Tu_1$ refers to undercooling temperature 1 at point A, $Tu_2$ refers to undercooling temperature 2, and Tg refers to the glass transition temperature.

Figure 3:
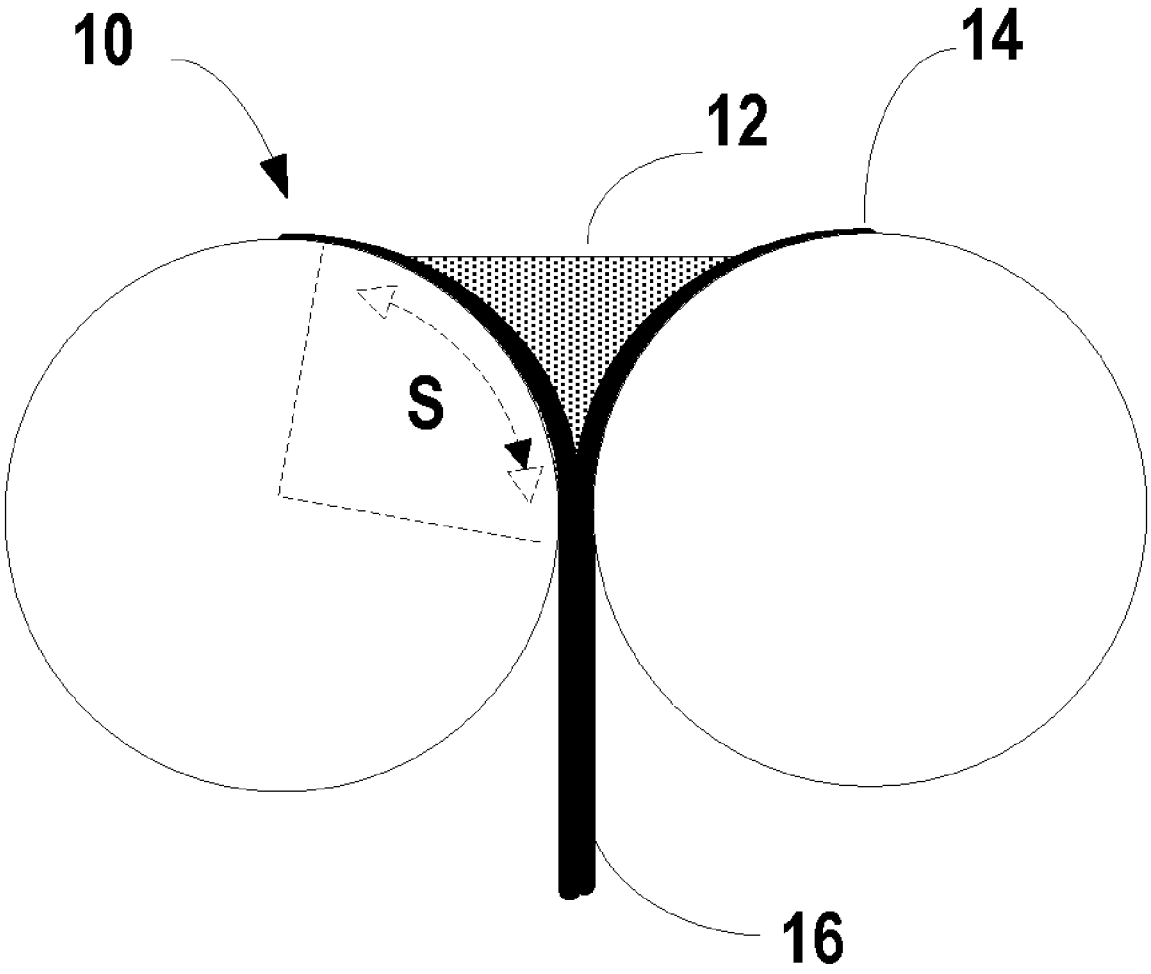
FIG. 3 illustrates a schematic diagram of an exemplary twin roll casting rollers.

FIG. 3 illustrates another exemplary embodiment of twin roll casting process 10. The rolls 14 may be counter-rotating forming a nip through which the liquid alloy 12 is passed. Upon passing through the nip and by contact with the rolls the alloy begins to solidify along the roll surface and is brought together to form a solid strip 16. Also, as shown is the total effective chill surface (represented in phantom by arc S), which may be less than or equal to one fourth of the roll circumference. For example, for a 500 mm diameter roll results in only 393 mm (15.5") of total chill surface for the roll. Accordingly, it should be appreciated that by increasing the diameter of the chill roll, the roll may exhibit a larger surface area. However, the total chill surface may still be approximately one forth of the roll circumferences.

Figure 4:
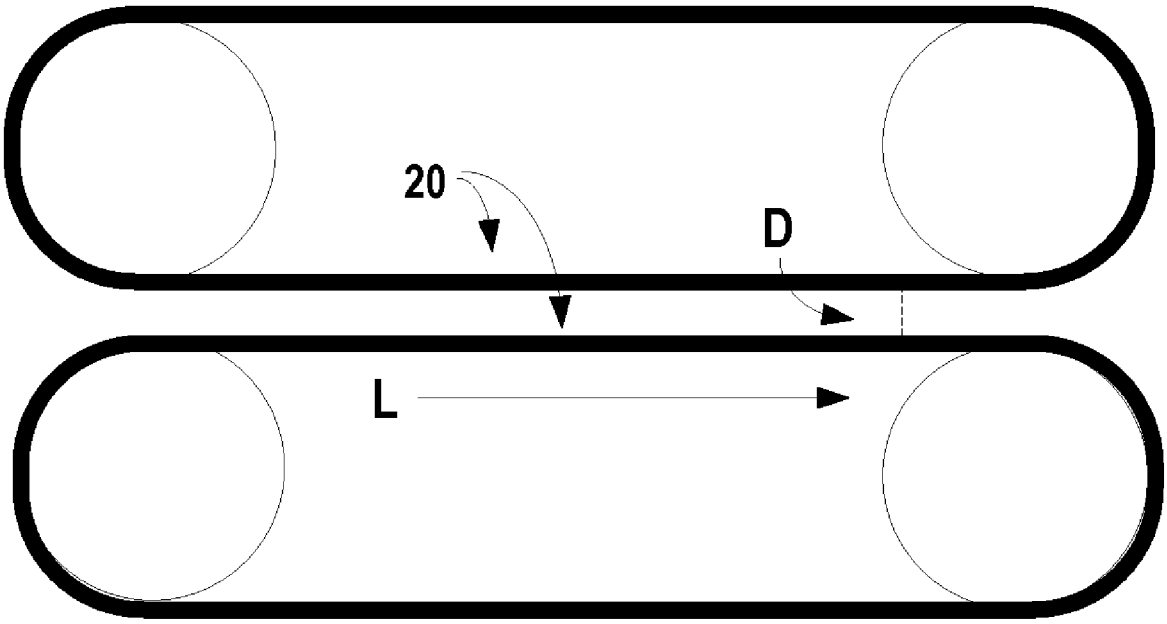
FIG. 4 illustrates a schematic diagram of an exemplary twin belt casting process.

In another exemplary embodiment, a twin belt may be utilized as shown in FIG. 4. In this approach, two chill surfaces may be provided which may allow for cooling of the alloy from both sides. The total chill surface 20 (encompassing both the surfaces of the top and bottom rolls forming the nip) may be much larger, i.e. longer, and varied in length. The twin belts may be made out of high melting point steel or highly conductive metals such as copper, silver, gold or alloys derived from these elements. The nip portion or entirety of the twin belts may be cooled using water or other suitable coolant. The belts may be arranged in a horizontal fashion (at an angle of 0°) as shown or at an angle up to vertical, such an angle in the range of +/−1 to 180°, including all increments and values therein. In addition, the belts may be adjusted so as to provide constant pressure on the alloy as it cools through out the forming processes, as the cooling alloy may tend to shrink. In such a manner, the distance D (illustrated by the phantom line) between the belt surfaces may be reduced along the belt length L.

Figure 5:
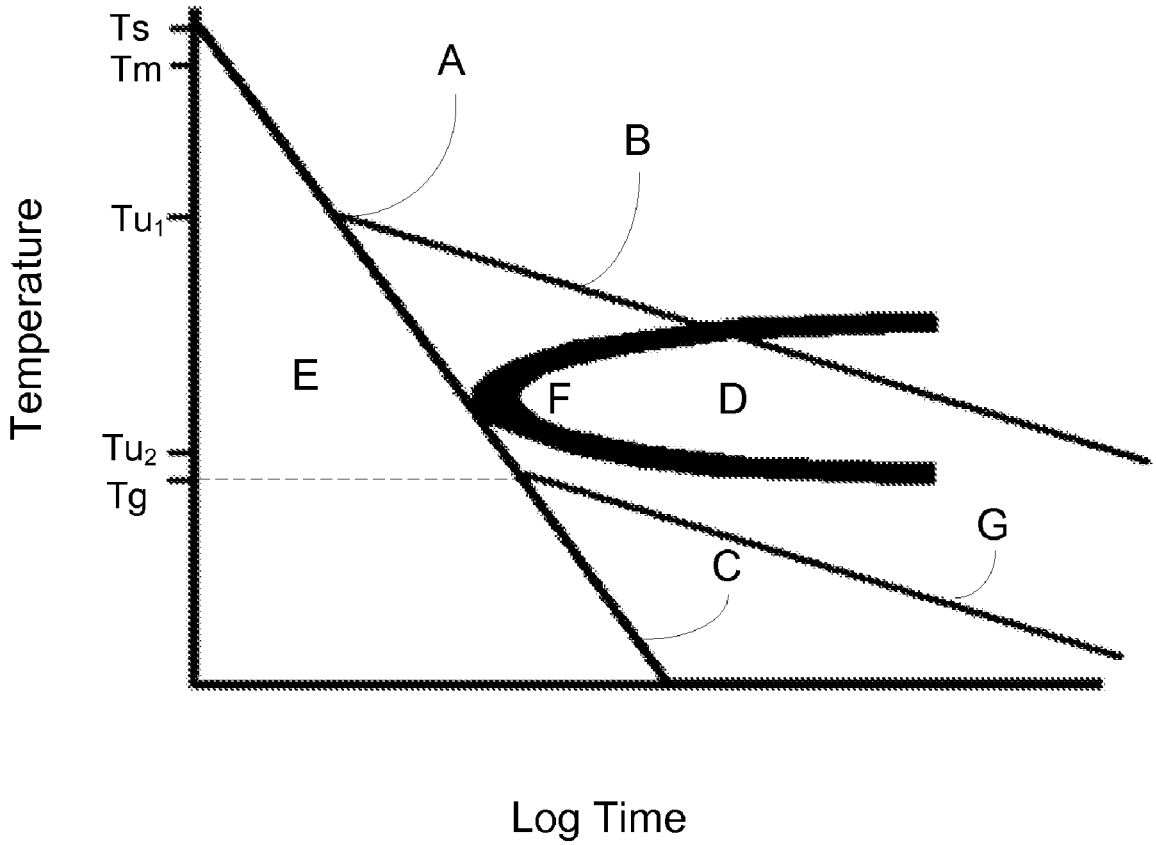
FIG. 5 illustrates a model CCT diagram showing the effects of the two-stage cooling process as a function of solidifying a liquid melt on a twin roll and twin belt caster.

As illustrated in FIG. 5, the liquid melt may undergo single stage cooling if the melt remains on the chill surface of the belts for a sufficient period of time, such that the initial cooling represented by curve C is rapid and the cooling rate is high. The total length of the belts may be adjusted so that the liquid melt comes off at a temperature where metallic glass precursors may be formed. If metallic glass precursor sheet is formed, it can then be transformed through various relaxation, recovery, single stage, and multiple stage heat treatments into specific nanoscale structures with a range of targeted sets of properties. Ideally, and as illustrated at G, the point of melt removal would be at the glass transition temperature Tg so that the second stage slow cooling would not cause nucleation.

Figure 6:
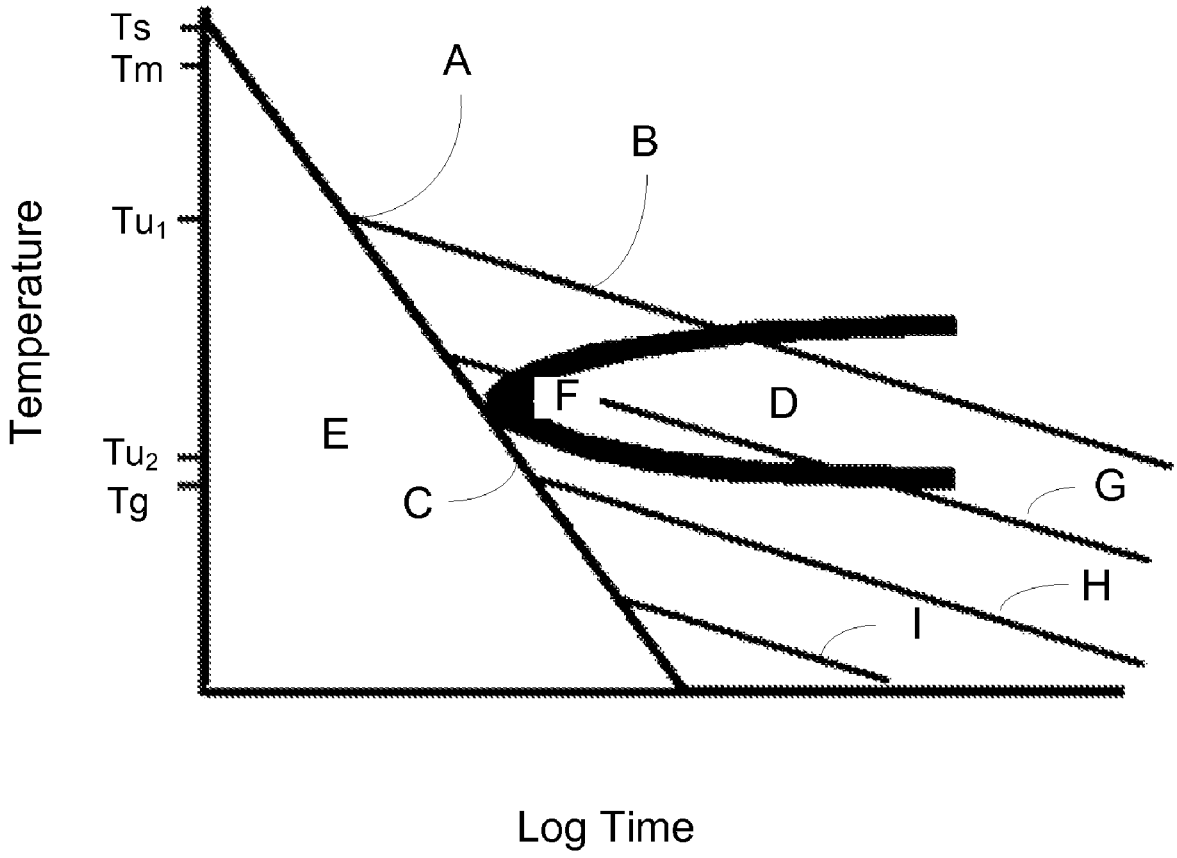
FIG. 6 illustrates a model CCT curve showing the effects of twin belt casting length as a function total undercooling achieved and its effect on the two stage cooling.

As illustrated in FIG. 6, the longer the chill belt, the longer the liquid melt may undergo rapid cooling represented by curve C. As the total belt length is increased, more heat can be removed allowing for an ever greater of undercooling before the sheet is removed. Achieving a much higher level of undercooling would then better enable for the production of amorphous sheet, plate, or strip. Accordingly, the longer the belt the less secondary cooling may occur, represented by lines B, G, H, and I wherein B represents the secondary cooling for a belt of a first length $L_1$, G represents a belt of a second length $L_2$, H represents a belt of a third length $L_3$ and I represents a belt of a fourth length $L_4$, wherein $L_1<L_2<L_3<L_4$. Note that even if the two stage cooling does not avoid the nose of the CCT curve, such that the cooling curve passes through the crystalline transformation region, the higher undercooling would still allow the production of nanoscale (i.e. 10 to 150 nm), or near nanoscale (i.e. 150 to 1000 nm) steel sheet, plate, strip, or other geometry.

Accordingly, the chill surface may be at a temperature that is sufficiently low enough and exhibit a rate of heat flow that is sufficiently high enough to prevent nucleation from occurring at the surface and, preferably, throughout the thickness of the alloy. In addition, it should be appreciated that while some nucleation may occur, the microstructure size or growth may be limited to nano or near nano scale.

Accordingly, if the critical cooling rate of the steel alloy is higher than that of a given cooling process, the ability to form a completely amorphous alloy may be compromised. However, due to the glass forming nature of the alloys herein, high undercooling may still occur prior to nucleation. Since nucleation may occur in the glass forming alloys herein at several hundred degrees lower undercooling than a conventional steel alloy, much greater microstructural refinement may still occur. That is, although not completely amorphous, relatively smaller crystalline domains may still be formed with advantageous properties in those situations where the critical cooling rate of the glass forming steel alloys is higher than that of an applied cooling protocol. A lath eutectoid may form in this case is one made up of alternating platelets/laths with thickness's from 200 to 800 nm in size, including all values and increments therein. A lath eutectoid may be understood as alternating near nanoscale laths of ductile iron and complex carbide phases such as borocarbide.

The properties produced from the steel may depend on a number of factors including the level of microstructural refinement, the microstructure that is produced and its constituent phases, the glass forming steel alloy chemistry, the manufacturing process chosen, the level of supersaturation, the post processing conditions (if needed), etc. The contemplated macrohardness may be approximately in the range of Rockwell C from 64 to 80, including all values and increments therein. This hardness may be understood to represent the hardness of the bulk which is an average of the matrix and individual phases. The microhardness may vary depending on the type of phases which are formed and may be approximately in the range of HV 300 from about 100 kg/mm$^2$ to 3000 kg/mm$^2$ including all values and increments therein, such as 230 to 2500 kg/mm$^2$, 850 to 2,000 kg/mm$^2$. The contemplated tensile strength may be in the approximate range of 100,000 lb/in$^2$ to 950,000 lb/in$^2$, including all values and increments therein such as 170,000 lb/in$^2$ to 480,000 lb/in$^2$. The contemplated tensile elongation at room temperature may be in the approximate range of 0.01 to 40% including all values and increments therein, such as 1 to 20%. At elevated temperatures, such as those greater than room temperature, the contemplated tensile elongation may be approximately in the range of 0.1 to 280% including all values and increments therein, such as 4 to 60%. Thus, the tensile elongation may be high at elevated temperatures and may allow thermomechanical transformation (if necessary) of the slab, strip, or sheet products into industrially usable shapes and sizes.

The near nanostructured steel alloys may be used in a number of applications. In one exemplary embodiment, the steel alloys may be used in applications where there may be exposure to highly corrosive or abrasive environments. The alloys may therefore be used to replace or in combination with nickel base superalloys, (i.e. 625, C-22) or stainless steels (i.e. 316, 304, 430, etc.). The steel may be used as or may assume the configuration of a wear plate which may be used as a replacement for or in combination with conventional high hardness sheet material like tool steel, Hardox, Brinell 500, etc, or weld overlay wear plates such as those hardfaced with chrome carbide, WC, complex carbide, tungsten carbide etc. The wear plate produced may have wide applicability in the heavy construction, mining, and material handling industries in a number of applications including but not limited to chutes, ground engaging tools, truck beds, undercarriage components etc. Additional uses of the near nanostructured sheet may include aerospace applications, steel armor or military armor plate, protecting infrastructure, civilian vehicles and military vehicles, wherein the alloys may be used to replace or in combination with titanium alloys, ultra high strength steel, ceramic materials, conventional armor steel or reactive armor steel etc.

The foregoing description is provided to illustrate and explain the present invention. However, the description hereinabove should not be considered to limit the scope of the invention set forth in the claims appended here to.

What is claimed is:

1. A method of producing an iron alloy sheet comprising:

melting an iron alloy comprising iron, boron, carbon, silicon, chromium, and manganese to obtain an iron alloy melt wherein said iron alloy has a melting point in the range of 1100° C. to 1500° C. and a critical cooling rate for metallic glass formation of less than $10^5$ K/s; and cooling said iron alloy melt using a twin belt casting process into a sheet having a thickness of 0.3 mm to 30 mm, by cooling said iron alloy melt between an upper belt and a lower belt, wherein said belts are separated by a distance wherein the distance between the belt surfaces are reduced along the belt length compensating for the shrinkage of said iron alloy and providing constant pressure on said iron alloy as it cools, wherein said sheet is cooled at a rate of less than $10^4$ K/s to produce no metallic glass and structural units in the range of 150 nm to 1000 nm, and/or 10 nm to 150 nm wherein said sheet includes α-Fe, γ-Fe and complex borocarbide phases, and wherein said sheet exhibits a hardness HV 300 in the range of 100 kg/mm$^2$ to 3,000 kg/mm$^2$, a tensile strength in the range of 100,000 lb/in$^2$ to 950,000 lb/in$^2$, a tensile elongation at room temperature in the range of 1% to 40% and a tensile elongation at temperatures greater than room temperature in the range of 1% to 280%.

2. The method of claim 1 further including iron alloy having structural units of greater than or equal to 1 micron.

3. The method of claim 1 wherein said iron alloy component further comprises phases selected from the group consisting of complex carbide, complex boride, and combinations thereof.

4. The method of claim 1 wherein said iron alloy component comprises about 50% by vol. or greater structural units in the range of about 150 nm to 1000 nm.

5. The method of claim 1 comprising about 50% by vol. or greater of structural units in the range of about 10 nm to 150 nm.

6. The method of claim 1 wherein said iron alloy is undercooled in the range of 500° C. to 1000° C.

7. The method of claim 1 wherein said sheet has a thickness of 0.5 mm to 30 mm.

8. A method of producing an iron alloy sheet comprising:

melting an iron alloy comprising iron, boron, carbon, silicon, chromium, niobium, and manganese to obtain an iron alloy melt wherein said iron alloy has a melting point in the range of 1100° C. to 1500° C.; and cooling said iron alloy melt into a sheet having a thickness of 0.3 mm to 30 mm, wherein said sheet is cooled at a rate of less than $10^4$ K/s to produce no metallic glass and structural units in the range of 150 nm to 1000 nm, and/or 10 nm to 150 nm, wherein said sheet includes α-Fe, γ-Fe and complex borocarbide phases, and wherein said sheet exhibits a hardness HV 300 in the range of 100 kg/mm$^2$ to 3,000 kg/mm$^2$, a tensile strength in the range of 100,000 lb/in$^2$ to 950,000 lb/in$^2$, a tensile elongation at room temperature in the range of 1% to 40% and a tensile elongation at temperatures greater than room temperature in the range of 1% to 280%.

* * * * *

UNITED STATES PATENT AND TRADEMARK OFFICE

CERTIFICATE OF CORRECTION

PATENT NO. : 8,133,333 B2
APPLICATION NO. : 11/874361
DATED : March 13, 2012
INVENTOR(S) : Daniel James Branagan et al.

It is certified that error appears in the above-identified patent and that said Letters Patent is hereby corrected as shown below:

In column 9, line 13, in Claim 8, after "chromium," delete "niobium,".

Signed and Sealed this
Eighth Day of May, 2012

David J. Kappos

David J. Kappos
*Director of the United States Patent and Trademark Office*